United States Patent [19]

Morton

[11] 4,288,725

[45] Sep. 8, 1981

[54] LIGHTWEIGHT FLUORESCENT LAMP BALLAST

[75] Inventor: Edward W. Morton, Teaneck, N.J.

[73] Assignee: Westinghouse Electric Corp., Pittsburgh, Pa.

[21] Appl. No.: 97,273

[22] Filed: Nov. 26, 1979

[51] Int. Cl.[3] ..... H05B 41/18

[52] U.S. Cl. ..... 315/245; 315/53; 315/58; 315/99; 315/DIG. 5

[58] Field of Search ..... 315/58, 99, 100, 227 R, 315/245, 246, 247, 291, DIG. 5, 49, 53, 179, 187

[56] References Cited

U.S. PATENT DOCUMENTS

| | | | |
|---|---|---|---|
| 2,297,257 | 9/1942 | Seitz | 315/245 X |
| 2,356,369 | 8/1964 | Abernathy | 315/227 R |
| 3,996,493 | 12/1976 | Davenport et al. | 315/58 |

*Primary Examiner*—Eugene R. La Roche
*Attorney, Agent, or Firm*—R. S. Lombard

[57] ABSTRACT

A lightweight starting and operating ballasting means for starting and operating a fluorescent lamp means from a household source of AC energy. The ballasting means has elements which perform with the lamp means in a starting mode and an operating mode. In the operating mode with a low-pressure mercury discharge existing between the lamp electrodes, the lamp means is ballasted solely by a series-connected resistor means and capacitor means.

3 Claims, 2 Drawing Figures

LIGHTWEIGHT FLUORESCENT LAMP BALLAST

BACKGROUND OF THE INVENTION

This invention relates to fluorescent lamp ballasts and, in particular, to a fluorescent lamp ballast that is light in weight compared to an inductive ballast and conserves energy.

Despite their widespread use, incandescent lamps are relatively inefficient, with a 100 watt lamp producing about 16 lumens per watt of input power and having a relatively short service life as compared to other light sources. Fluorescent lamps, which have efficiencies as high as 80 lumens per watt, provide an attractive alternative to incandescent lighting. Increased residential use of fluorescent illumination, with attendant savings of energy, can be achieved from the development of fluorescent lamp systems which are directly compatible with existing sockets. However, lamps of this variety generally require a lightweight ballast if it is desired to retrofit fluorescent lamp systems in existing incandescent sockets.

One such lightweight ballast is disclosed in U.S. Pat. No. 2,356,369 dated Aug. 22, 1944, issued to David W. Abernathy. The Abernathy Patent discloses a fluorescent lighting circuit that utilizes a purely resistive ballast during normal operation of the fluorescent lighting tube. The use of a resistive ballast of this type is less expensive than an inductive ballast and is lighter in weight.

Another resistively ballasted fluorescent lamp is disclosed in U.S. Pat. No. 3,996,493 dated Dec. 7, 1976, issued to Davenport et al. The Davenport Patent discloses an integral self-contained fluorescent lamp unit comprising an elongated lamp and an elongated ballast resistor carried in an outwardly extending housing member positioned alongside the lamp.

A problem is often encountered with resistively ballasted fluorescent lighting systems in that the resistor consumes excessive power and, in addition, it is often difficult to dissipate the excessive heat generated by the resistor.

SUMMARY OF THE INVENTION

There is provided a lightweight starting and operating ballasting means for starting and operating a relatively low wattage fluorescent lamp means from a household source of AC energy. The fluorescent lamp means comprises an elongated tubular light-transmitting envelope having electrodes positioned therein proximate each end thereof. The electrodes each comprise an elongated tungsten coil having a lead-in member affixed to each end of the coils and sealed through the ends of the envelope. The envelope encloses a discharge-sustaining filling comprising mercury and a low pressure of inert ionizable starting gas. A phosphor material layer is carried on the interior surface of the envelope. The fluorescent lamp means has a normal operating voltage drop thereacross, not exceeding about 65 volts.

The ballasting means has elements which perform with the lamp means in a starting mode and an operating mode. The ballasting means in the starting mode consists of a closed electrically-conducting current-interrupting means connecting exteriorly of the lamp means to one of the lead-in members at each end of the lamp means to form with the electrode coils a series electrode-coil-preheat circuit. Resistor means of predetermined value and capacitor means of predetermined value are connected in series circuit exteriorly of the lamp means with said series electrode-coil-preheat circuit to form a composite series circuit. The composite series circuit is adapted to be connected across a standard household source of AC energy intended for operating the lamp means, whereby on application of the household AC energy across the composite series circuit, the electrode coils are preheated and the atmosphere within the lamp means envelope is ionized.

The ballasting means thereafter shifts to the operating mode by the current-interrupting means opening to open the electrode-coil-preheat series circuit, with the household AC energy then applied across the preheated coils to initiate and maintain a low-pressure mercury discharge between the lamp electrodes, with the operation of the lamp means thereafter normally continuing as ballasted solely by the series-connected resistor means and capacitor means.

BRIEF DESCRIPTION OF THE DRAWINGS

For a better understanding of the invention, reference may be had to the accompanying drawings exemplary of the invention, in which.

BRIEF DESCRIPTION OF THE PREFERRED EMBODIMENTS

Figure 1:
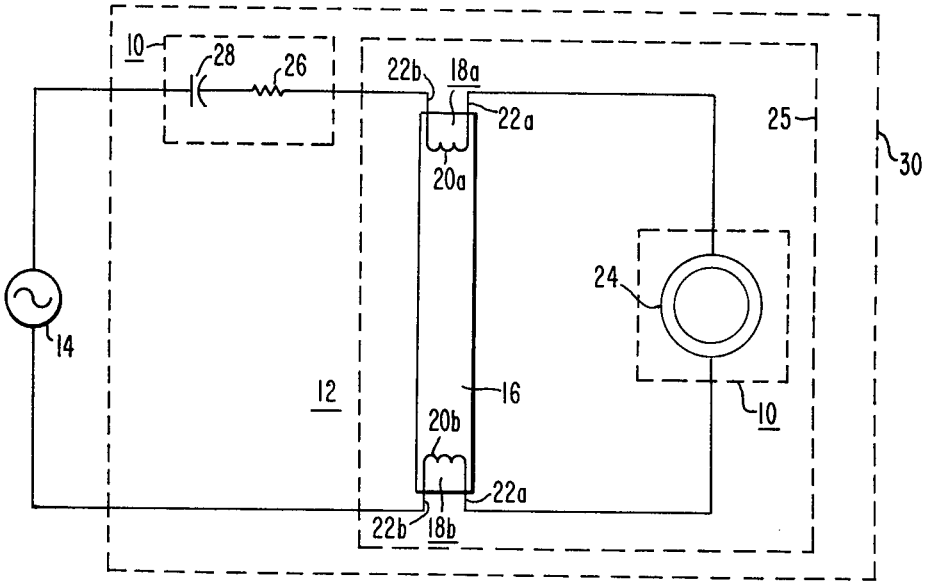
FIG. 1 is a schematic diagram of the lightweight starting and operating ballasting means and the fluorescent lamp means.

In FIG. 1 is shown a lightweight starting and operating ballasting means 10 for starting and operating a fluorescent lamp means 12 from a household source of AC energy, typically 120 volts, 60 Hz. The fluorescent lamp means 12 comprises an elongated tubular light-transmitting envelope 16 having electrodes 18*a*, 18*b* positioned therein proximate each end thereof. The electrodes 18*a*, 18*b* each comprise an elongated tungsten coil 20*a*, 20*b* having a lead-in member 22*a*, 22*b* affixed to each end of each of the coils 20*a*, 20*b* and sealed through the ends of the envelope 16. The envelope 16 encloses a discharge-sustaining filling comprising mercury and a low pressure of inert ionizable starting gas, and a phosphor material layer is carried on the interior surface of the envelope. The relatively low wattage fluorescent lamp 12 has a normal operating voltage drop thereacross not exceeding about 65 volts. As an example, the lamp wattage normally will not exceed about 25 watts.

Ballasting means 10 has elements which perform with the lamp means 12 in a starting mode and an operating mode. The ballasting means 10 in the starting mode consists of a closed electrically-conducting current-interrupting means 24 connecting exteriorly of the lamp means to one of the lead-in members 22*a* at each end of the lamp means 12 to form with the electrode coils 20*a*, 20*b* a series electrode-coil-preheat circuit 25. The current interrupting means 24 may be a glow-switch starter, a pushbutton, or other suitable starting device as well known in the art. Resistor means 26 of predetermined value and capacitor means 28 of predetermined value are connected in series circuit exteriorly of the lamp means 12 with the series electrode-coil-preheat circuit 25 to form a composite series circuit 30 adapted to be connected across a standard household source 14 of AC energy intended for operating the lamp means 12, whereby on application of the household AC energy across the composite series circuit 30, the electrode coils 20*a*, 20*b* are preheated and the atmosphere within the lamp means envelope 16 is ionized.

The ballasting means 10 thereafter shifts to the operating mode by the current-interrupting means 24 opening to open the electrode-coil-preheat series circuit 25. The household source 14 of AC energy is then applied across the preheated coils 20*a*, 20*b* to initiate and maintain a low-pressure mercury discharge between the lamp electrodes 18*a*, 18*b*, with the operation of the lamp means 12 thereafter normally continuing as ballasted solely by the series-connected resistor means 26 and capacitor means Utilizing this arrangement with the series-connected resistor means 26 and capacitor means 28 avoids drawbacks associated with using only a resistor or a capacitor as a ballast. The drawback associated with using a capacitor as a ballast is that it causes unstable operation of a fluorescent lamp resulting in short lamp life, and the drawback associated with using a resistor as a ballast is that it results in the lamp ballast system consuming more power than a combination resistor and capacitor as the ballast.

It has been found that the use of a low-power dissipation factor capacitor in series with the resistor to limit the lamp current provides the necessary lamp voltage at a reduced system power input when compared to a "pure" resistively ballasted system. This is accomplished while maintaining comparable light output as provided by a resistively or inductively ballasted lamp. Low-power dissipation factor (DF) capacitors are characterized by low effective series resistance (ESR) and therefore, low power consumption. Preferably the capacitor means 28 should have a power dissipation factor not greater than 0.012 at 25° C.

The following example gives a sample calculation of the power consumed ($P_c$) by the capacitor.

EXAMPLE $$DF = TAN\ \theta = (ESR)/X_c$$

$$X_c = 1/(2\pi fc)$$

| | |
|---|---|
| $P_c$ = Power consumed by the capacitor | $P_c = I_c^2\,(ESR) = I_c^2\,(DF/2\pi fe)$ |
| $I_c$ = Capacitor current | For C = 10μF<br>F = 60 hz<br>(typical) DF = 0.0075<br>at $I_c$ = 0.4 amp<br>$P_c$ = 0.31 watt |

In the following Table, a resistively ballasted lamp system is compared with a resistor-capacitor ballasted lamp system of the present invention. A 15" long 14 watt fluorescent lamp was used in obtaining this data:

TABLE

| Ballast Used | | | | Input | | |
|---|---|---|---|---|---|---|
| Resistor | Resistor-Capacitor | Weight (grams) | Watts | Volts | Current (ma) | Output Lumens |
| 250 ohms | — | 46 | 42 | 120 | 350 | 590 |
| — | 100 ohm resistor with 10 μF capacitor | 44 | 29 | 120 | 378 | 590 |

As shown in the Table there is a significant power reduction utilizing this arrangement which will work on lamps having an envelope up to about 2 feet in length due to voltage drop. The capacitor means 28 shown in FIG. 1 may vary from about 5 microfarads to 100 microfarads and the resistor 26 may vary from about 30 ohms to 300 ohms. The combined impedance of the resistor means 26 and the capacitor means 28 is such that the lamp means 12 operates with a predetermined power consumption, and the ratio of the impedance of the resistance means 26 to the impedance of the capacitor means 28 should be from about 0.057 to 11.3. A total impedance both resistive and capacitive of 275 ohms is preferred although the ballast 10 will be effective between 100 ohms to 550 ohms.

Figure 2:
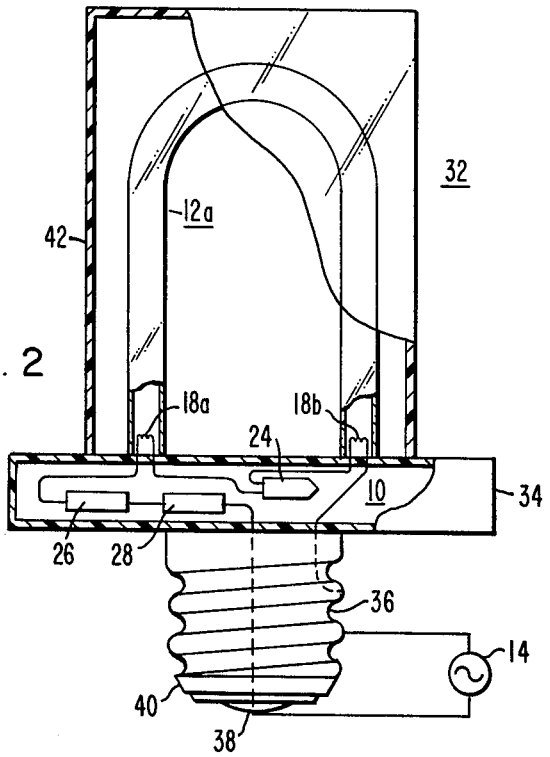
FIG. 2 is an elevational view, partly in section, of a lightweight fluorescent lamp unit including a compact fluorescent lamp means and the lightweight starting and operating ballasting means of the present invention.

Referring to FIG. 2, there is shown a lightweight fluorescent lamp unit 32, including a compact tubular U-bent fluorescent lamp 12*a*. The capacitor 28 and resistor 26 along with the current interrupting means 24 are housed within housing 34 and connected in the circuit as shown. Housing 34 may be made of plastic or any other suitable material. Metallic shell 36 and metallic eyelet 38 and insulator 40 are standard lamp parts. Protective transparent cover 42 is made of clear plastic and is provided to prevent the lamp 12 from being damaged. Of course, many other arrangements such as this are possible.

I claim:

1. A lightweight starting and operating ballasting means for starting and operating a fluorescent lamp means from a household source of AC energy, said fluorescent lamp means comprising an elongated tubular light-transmitting envelope having electrodes positioned therein proximate each end thereof, said electrodes each comprising an elongated tungsten coil having a lead-in member affixed to each end of each said coils and sealed through the ends of said envelope, said envelope enclosing a discharge-sustaining filling comprising mercury and a low pressure of inert ionizable starting gas, and a phosphor material layer carried on the interior surface of said envelope, said fluorescent lamp means having a normal operating voltage drop thereacross not exceeding about 65 volts, and said ballasting means having elements which perform with said lamp means in a starting mode and an operating mode as follows:

a. said ballasting means in said starting mode consisting of a closed electrically-conducting current-interrupting means connecting exteriorly of said lamp means to one of said lead-in members at each end of said lamp means to form with said electrode coils a series electrode-coil-preheat circuit, resistor means of predetermined value and capacitor means of predetermined value connecting in series circuit exteriorly of said lamp means with said series electrode-coil-preheat circuit to form a composite series circuit, and said composite series circuit adapted to be connected across the standard household source of AC energy intended for operating said lamp means; whereby on application of said household AC energy across said composite series circuit, said electrode coils are preheated and the atmosphere within said lamp means envelope is ionized; and b. said ballasting means thereafter shifting to said operating mode by said current-interrupting means opening to open said electrode-coil-preheat series circuit, with the household source of AC energy then applied across said preheated coils to initiate and maintain a low pressure mercury discharge between said lamp electrodes, with the operation of said lamp means thereafter normally continuing as ballasted solely by said series-connected resistor means and capacitor means.

2. The starting and operating ballasting means as specified in claim 1, wherein the combined impedance of said resistor means and said capacitor means is such that said lamp means operates with a predetermined power consumption, and the ratio of the impedance of said resistance means to the impedance of said capacitor means is from about 0.057 to 11.3.

3. The starting and operating ballasting means as specified in claim 1, wherein said capacitor means has a power dissipation factor not greater than 0.12 at 25° C.

* * * * *